US010022778B2

(12) United States Patent
Goto et al.

(10) Patent No.: US 10,022,778 B2
(45) Date of Patent: Jul. 17, 2018

(54) COIL SPRING FORMING METHOD AND FORMING DEVICE

(71) Applicant: CHUO HATSUJO KABUSHIKI KAISHA, Nagoya-Shi (JP)

(72) Inventors: Takashi Goto, Nagoya (JP); Shinsuke Okura, Nagoya (JP); Takashi Yamashita, Nagoya (JP)

(73) Assignee: CHUO HATSUJO KABUSHIKI KAISHA, Nagoya-Shi (JP)

( * ) Notice: Subject to any disclaimer, the term of this patent is extended or adjusted under 35 U.S.C. 154(b) by 126 days.

(21) Appl. No.: 15/024,511

(22) PCT Filed: Sep. 2, 2014

(86) PCT No.: PCT/JP2014/073060

§ 371 (c)(1),
(2) Date: Mar. 24, 2016

(87) PCT Pub. No.: WO2015/045756

PCT Pub. Date: Apr. 2, 2015

(65) Prior Publication Data

US 2016/0207091 A1 Jul. 21, 2016

(30) Foreign Application Priority Data

Sep. 26, 2013 (JP) ..... 2013-199377

(51) Int. Cl.
*B21F 35/02* (2006.01)
*B21F 3/04* (2006.01)

(52) U.S. Cl.
CPC ..... *B21F 35/02* (2013.01); *B21F 3/04* (2013.01)

(58) Field of Classification Search
CPC .. B21F 35/00; B21F 35/02; B21F 3/00; B21F 3/02; B21F 3/04
See application file for complete search history.

(56) References Cited

U.S. PATENT DOCUMENTS 4,424,695 A 1/1984 Kirchhoff et al.
4,444,036 A 4/1984 Shibata et al.
4,571,973 A 2/1986 Morita
(Continued)

FOREIGN PATENT DOCUMENTS

CN 102388232 A 3/2012
CN 203076501 U 7/2013
(Continued)

OTHER PUBLICATIONS

Office Action from the Japanese Patent Office dated Jun. 6, 2017 in related Japanese application No. 2013-199377, and translation thereof.

(Continued)

*Primary Examiner* — Teresa M Ekiert
(74) *Attorney, Agent, or Firm* — J-TEK Law PLLC; Jeffrey D. Tekanic; Scott T. Wakeman

(57) ABSTRACT

A method for forming a wire into a coil spring includes winding the wire around a coiling mandrel to form the wire into a cylindrical coil shape, clamping one end of the wire formed into the cylindrical coil shape, clamping an intermediate portion of the wire spaced from the clamped one end of the wire; and moving the clamped one end of the wire relative to the clamped intermediate position at least in an axis direction of the cylindrical coil shape, whereby a pigtail having a desired shape is formed.

20 Claims, 3 Drawing Sheets

(56) References Cited

U.S. PATENT DOCUMENTS

| | | | |
|---|---|---|---|
| 4,576,028 | A | 3/1986 | Morita |
| 4,945,744 | A | 8/1990 | Lienert |
| 4,967,580 | A | 11/1990 | Morita |
| 2005/0045241 | A1 | 3/2005 | Dixon et al. |
| 2009/0283173 | A1 | 11/2009 | Eto |
| 2012/0013059 | A1 | 1/2012 | Hamano et al. |
| 2015/0101699 | A1 | 4/2015 | Eto |

FOREIGN PATENT DOCUMENTS

| | | | |
|---|---|---|---|
| JP | S57011743 | | 1/1982 |
| JP | S6350098 | B2 | 10/1988 |
| JP | H01170540 | A | 7/1989 |
| JP | H2070342 | A | 3/1990 |
| JP | H031090 | B2 | 1/1991 |
| JP | H3056816 | B2 | 8/1991 |
| JP | H03189036 | A | 8/1991 |
| JP | H10099928 | | 4/1998 |
| JP | 2001-214949 | A | 8/2001 |
| JP | 2003290860 | A | 10/2003 |
| JP | 2005118876 | A | 5/2005 |
| JP | 2005349447 | A | 12/2005 |
| JP | 2007319863 | A | 12/2007 |
| JP | 2009061505 | A | 3/2009 |
| JP | 2010242835 | A | 10/2010 |
| JP | 4712179 | B2 | 6/2011 |
| WO | 2011065625 | A1 | 6/2011 |

OTHER PUBLICATIONS

Office Action from the Chinese Patent Office dated Dec. 30, 2016 in related Chinese application No. 201480052721.5, and translation thereof.

English translation of International Search Report for parent application No. PCT/JP2014/073060.

English translation of Written Opinion of the International Searching Authority for parent application No. PCT/JP2014/073060.

COIL SPRING FORMING METHOD AND FORMING DEVICE

CROSS-REFERENCE

This application is the US national stage of International Patent Application No. PCT/JP2014/073060 filed on Sep. 2, 2014, which claims priority to Japanese Patent Application No. 2013-199377 filed on Sep. 29, 2013.

TECHNICAL FIELD

The present teachings generally relate to methods and devices for forming or shaping a coil spring. More specifically, techniques for performing an additional process (e.g., a process for forming a pigtail) at an end of a coil spring are disclosed.

BACKGROUND ART

A coil spring manufactured by performing an additional process at an end (e.g., a coil spring having a pigtail formed on an end) is known. In order to manufacture this type of coil spring, first, a cylindrical coil spring (semi-finished product) is formed by winding a wire, which is the material of the coil spring, on a coiling mandrel, and an additional process is performed at an end of the cylindrical coil spring so as to be formed into the final form. In Japanese Patent Application Publication No. 2005-349447, a forming device for forming a pigtail at an end of a cylindrical coil spring is disclosed. In this forming device, a forming jig is attached to a rotating shaft. In addition, one end (open end) of the wire of the cylindrical coil spring is fixed to the forming jig (coiling mandrel) by a first locking mechanism, and, within the wire of the coil spring, the location that starts the formation of the pigtail is clamped by a second locking mechanism. Then, by rotating the rotating shaft about its axis and moving the rotating shaft within a plane orthogonal to the rotational axis, the wire of the coil spring is wound on the forming jig to form the pigtail at an end of the cylindrical coil spring.

SUMMARY OF THE INVENTION

With a forming device according to the prior technology, since the rotating shaft is moved only within the plane orthogonal to the rotational axis when forming a pigtail, the wire of the coil spring cannot be formed into the desired shape in some cases. That is, with the prior forming device, the pitch of an end wound portion of the coil spring cannot be changed from the pitch that was made when the semi-finished product was formed. Due to this, in case the pitch of the end wound portion cannot be set to the desired pitch when forming the semi-finished product, the pitch of the end wound portion in the final product also does not become the desired pitch, either.

The present teachings aim to provide a technique that enables the formation of a pitch of an end wound portion of a coil spring to be a desired pitch when performing an additional process at the end of the coil spring.

According to a first aspect of the present teachings, a coil spring forming method includes forming (shaping) a wire into a cylindrical shape by winding the wire on (around) a first coiling mandrel to form a coil spring, and then further processing one end of the coil spring that has been formed into the cylindrical shape. The further processing comprises clamping a particular position other than the one end of the wire of the coil spring that has been formed into the cylindrical shape, clamping the one end of the wire of the coil spring formed into the cylindrical shape, and moving the clamped one end of the wire relative to the clamped particular position at least in an axis direction of the coil spring formed into the cylindrical shape.

In this coil spring forming method, when the end of the wire of the coil spring is being additionally processed, the one end of the wire of the coil spring is moved relative to the particular position of the wire of the coil spring at least in the axis direction parallel to an axis line of the coil spring formed into the cylindrical shape. Due to this, when forming the pigtail, an inter-wire distance of the coil spring changes, and the pitch of an end wound portion of the coil spring can be adjusted. The pitch of the end wound portion of the coil spring can thereby be formed with a desired pitch.

According to another aspect of the present teachings, a coil spring forming (shaping) device is disclosed that additionally processes one end of a coil spring formed into a cylindrical shape. That is, the forming (shaping) device disclosed herein comprises, a first clamp that clamps the one end of the coil spring formed into the cylindrical shape, a second clamp that clamps a particular position other than the one end of the wire of the coil spring formed into the cylindrical shape, a moving mechanism that moves the first clamp relative to the second clamp at least in an axis direction of the coil spring formed into the cylindrical shape, and a controller that drives the moving mechanism while the wire of the coil spring is clamped by the first clamp and the second clamp, and moves the first clamp relative to the second clamp at least in the axis direction. With such a forming (shaping) device, the coil spring can be formed with an end wound portion having a desired pitch.

DETAILED DESCRIPTION

Figure 1:
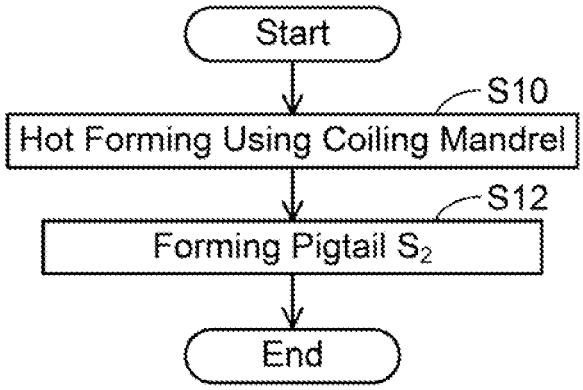
FIG. 1 is a flowchart showing a manufacturing process of a coil spring according to the present embodiment.

In the coil spring forming method disclosed herein, the second forming process may be performed by a clamp part provided on a rotating shaft in the state in which one end of the wire of the coil spring is clamped. In this case, the moving step may further include rotating the clamped one end of the wire relative to the clamped particular position about an x-axis, which is an axial line of the rotating shaft, and/or about a y-axis, which is orthogonal to the x-axis, and/or about a z-axis, which is orthogonal to the x-axis and the y-axis.

With a configuration as above described, the one end of the wire of the coil spring can be rotated relative to the particular position about at least one axis among the x-axis direction, the y-axis direction, and the z-axis direction. Due to this, the wire of the coil spring can be bent in any arbitrary direction, and the shape of the coil spring can be formed into a desired shape. In this forming method, in case the direction of the axial line (x-axis) of the rotating shaft is to be changed during the forming, the axial line of the rotating shaft at the start of the second forming process is defined as the x-axis. Thus, when the direction of the axial line (x-axis) of the rotating shaft is changed during the forming, the rotating axis (x-axis) will not be orthogonal relative to the y-axis and the z-axis. That is, during the forming, the axial line of the rotating shaft does not have to be constantly orthogonal relative to the y-axis and the z-axis. The definitions described above also apply similarly to the following aspects of the described forming method.

In the coil spring forming method disclosed herein, the moving step may further include moving the clamped one end of the wire relative to the clamped particular position in an x-axis direction, and/or in a y-axis direction, and/or in a z-axis direction. By having such a configuration, the diameter of the wire of the coil spring can be decreased or increased in any arbitrary direction.

In the coil spring forming method disclosed herein, a second coiling mandrel may be further provided on the rotating shaft. In this case, the moving step may include winding the wire of the coil spring on the second coiling mandrel by moving the clamped one end of the wire of the coil spring relative to the clamped particular position. By having such a configuration, since the additional process is performed at the end of the coil spring by winding the wire of the coil spring on the coiling mandrel, the end can be formed with fine accuracy.

In the coil spring forming method disclosed herein, the second coiling mandrel may move integrally with the clamped one end of the wire in the x-axis direction, and/or in the y-axis direction, and/or in the z-axis direction. By having such a configuration, since relative movement does not occur between the one end of the wire of the coil spring and the second coiling mandrel, the mechanism that clamps the one end (open end) of the coil spring to the second coiling mandrel can be configured in a simplified manner.

In the coil spring forming method disclosed herein, the second forming process may be performed with the coil spring formed into the cylindrical shape heated at 300° C. or higher. By having such a configuration, since the wire of the coil spring is formed in an easily deformable state, the processing forces required during the forming can be reduced.

EMBODIMENT

Figure 4:
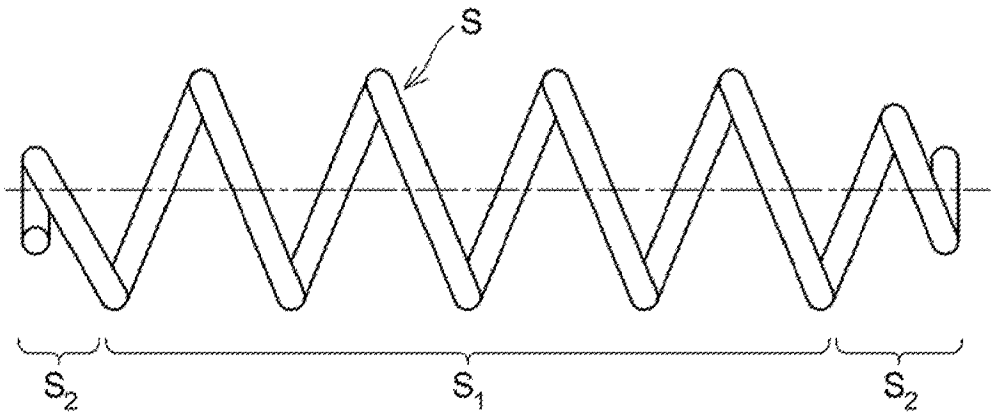
FIG. 4 shows an exterior view of the coil spring according to the present embodiment.
Figure 4:
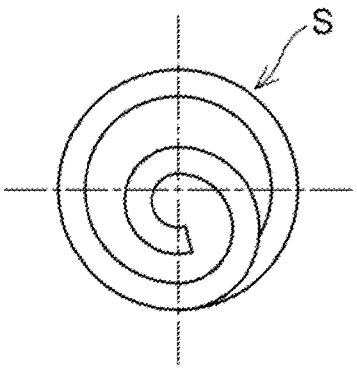

A coil spring forming method according to an embodiment will be described. First, a coil spring according to the embodiment will be described in a simple manner. The coil spring according to the embodiment is a coil spring for a strut-type suspension device installed in an automobile or the like. As shown in FIG. 4, coil spring S has a cylindrical portion $S_1$ formed at its center, and pigtails $S_2$ formed at its both ends. A strut-type suspension device that uses the coil spring S includes a shock absorber disposed inside the coil spring S. In the strut-type suspension device, the direction of external force that acts upon a tire from the road surface does not coincide with the axial line of the shock absorber. Due to this, lateral forces act upon the shock absorber and problems such as a reduction in ride comfort are caused. In order to solve such problems, the lateral forces that act upon the shock absorber have to be reduced by tilting the load axis of the coil spring S to a desired angle. For example, in the coil spring S, the central axis of the cylindrical portion $S_1$ is shifted from the central axis of the pigtails $S_2$, and/or the end wound portion is tilted by adjusting the pitch of the pigtails $S_2$. Thus, the coil spring S according to the present embodiment is required to have the pigtails $S_2$ formed in a desired shape in order to tilt the load axis of the coil spring S by a desired angle.

Figure 2:
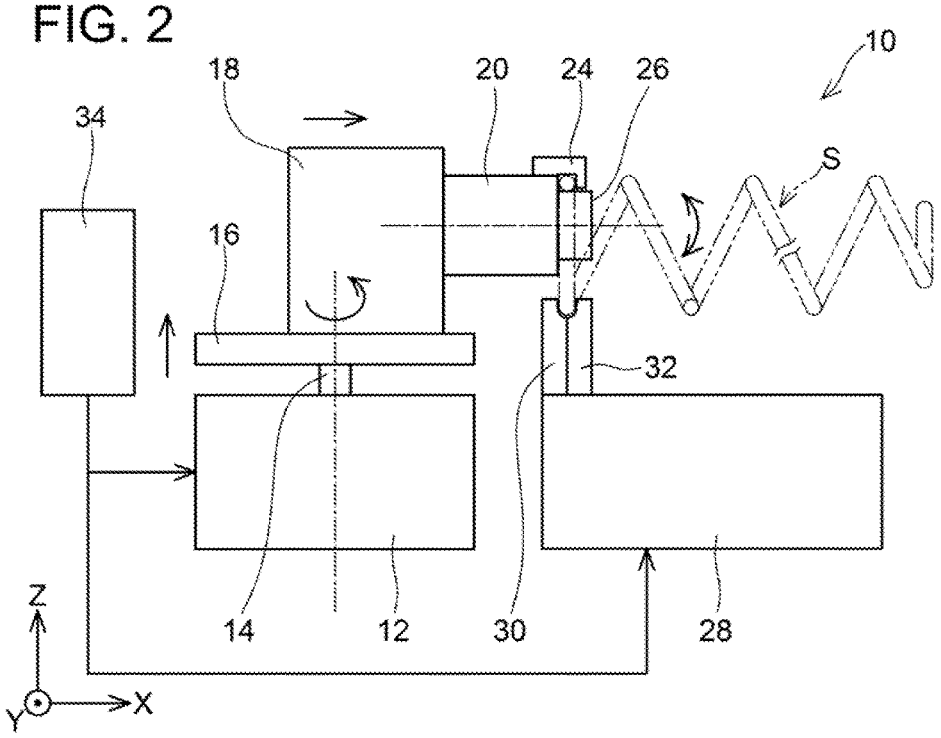
FIG. 2 is a lateral view that schematically shows a configuration of a forming device for forming a pigtail at an end of the coil spring according to the present embodiment.

First, the coil spring S described above is manufactured by processing a spring steel (e.g., SUP6, SUP9, SUP9A, SUP11A, etc.) into a wire material having a predetermined size. Next, as shown in FIG. 1, the wire material processed into the predetermined size is heated in a heating furnace, and the heated wire material is initially-formed into a cylindrical shape by winding the wire material on a coiling mandrel used for initial formation (one example of a first coiling mandrel) (S10). As shown in FIG. 2, in the initially-formed wire material (hereinafter, referred to as the wire material having the semi-finished product shape), a pigtail $S_2$ is formed at one end but a pigtail $S_2$ is not formed at the other end. That is, on the wire having the semi-finished product shape, when the cylindrical portion $S_1$ is formed, a pigtail $S_2$ is formed at the one end of the cylindrical portion $S_1$. However, a pigtail $S_2$ has not been formed at the other end of the cylindrical portion $S_1$.

Next, the pigtail $S_2$ is formed at the other end (the end not having the pigtail $S_2$ formed thereon) of the wire material having the semi-finished product shape (S12). As a result of this, the coil spring S shown in FIG. 4 is manufactured. The forming process at step S12 is preferably performed in a state where the wire material having the semi-finished product shape is heated to 300° C. or higher. For example, by performing the forming process of step S12 subsequent to the forming process of step S10 without a time interval therebetween, the pigtail $S_2$ can be formed in the state where the wire material having the semi-finished product shape is at 300° C. or higher. Thus, by performing step S12 during the period when the heated wire material is cooling down, the temperature of the wire material, when step S12 is performed, can be made high. By configuring in such a manner, the processing forces applied when forming the pigtail $S_2$ can be reduced, and thus it is possible to reduce the size of a forming device 10, which will be be described later. In the following, the forming of the pigtail $S_2$ in step S12 performed on the wire material having the semi-finished product shape will be described in detail.

First, the forming device 10 configured to form the pigtail $S_2$ at an end of the wire material having the semi-finished product shape (which hereinafter may simply be referred to as a wire) will be described. As shown in FIG. 2, the forming device 10 comprises a main body (12, 14, 16, 18), a rotating shaft 20 rotatably attached to the main body (12, 14, 16, 18), and a clamping mechanism (30, 32 (one example of a second clamp)) configured to clamp a particular position in the end region of the wire S.

The main body (12, 14, 16, 18) comprises a base 12, a screw shaft 14, a moving table 16, and a slider 18. A not-shown driving device (motor, etc.) is arranged inside the base 12, and the driving device is connected to the screw shaft 14. The screw shaft 14 extends in a z-axis direction (vertical direction: a direction orthogonal to the axial line (i.e., x-axis) of the rotating shaft 20 when the forming starts), and has a lower end rotatably supported by the base 12. Upon operation of the driving device within the base 12, the screw shaft 14 thereby rotates. The moving table 16 is threadably-engaged with the screw shaft 14. When the screw shaft 14 rotates, the moving table 16 moves in the z-axis direction (vertical direction). The slider 18 is mounted on an upper surface of the moving table 16. The slider 18 is driven by a not-shown driving device (motor) to move back and forth in an x-axis direction (the direction of the axial line (i.e., x-axis) of the rotating shaft 20 when the forming starts)

and a y-axis direction (a direction of a y-axis that is orthogonal to the x-axis and the z-axis) relative to the upper surface of the moving table 16, and rockingly rotate about the z-axis (vertical axis).

The rotating shaft 20 is attached to the slider 18. The rotating shaft 20 extends on the side of the clamping mechanism (30, 32), and has one end supported by the slider 18. The one end of the rotating shaft 20 is rotatably supported relative to the slider 18 around the axial line thereof and is attached so as to be capable of rocking about the y-axis. When a not-shown driving device is activated, the rotating shaft 20 rotates about its axial line, and rockingly rotates about the y-axis by using its end on the side of the slider 18 as a support point.

Figure 3:
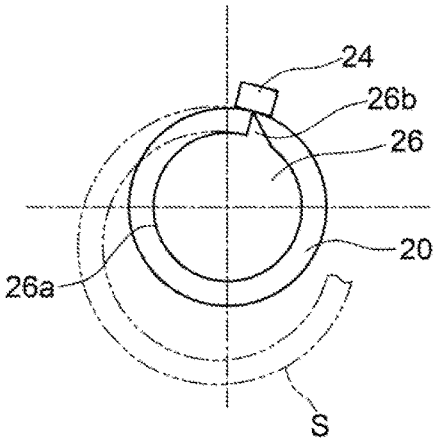
FIG. 3 shows the end of the coil spring and a forming jig (coiling mandrel) used when forming a pigtail at an end of the coil spring.

A coiling mandrel 26 (one example of a second coiling mandrel) and a clamp 24 (one example of a first clamp) are provided on the other end of the rotating shaft 20. As shown in FIGS. 2 and 3, the coiling mandrel 26 is a circular-cylindrical-shaped element, and has an outer circumferential surface 26*a* on which the wire S is to be wound. A protruding part 26*b* that protrudes radially outward is formed on the outer circumferential surface 26*a*. One end of the wire material having the semi-finished product shape S makes contact with the protruding part 26*b*. The clamp 24 holds the one end of the wire material having the semi-finished product shape S. Specifically, the one end of the wire S is clamped by the coiling mandrel 26 with the one end, whose end surface is in contact with the protruding part 26*b* of the coiling mandrel 26, being sandwiched by the clamp 24 and the outer circumferential surface 26*a* of the coiling mandrel 26. The clamp 24 can be switched by a not-shown driving device between a state of clamping the one end of the wire S and a state of not clamping the one end of the wire S. Since the coiling mandrel 26 and the clamp 24 are fixed to the rotating shaft 20, the coiling mandrel 26 and the clamp 24 also rotate in association with rotation of the rotating shaft 20.

The clamping mechanism (30, 32) is disposed at a position spaced from the base 12 in the direction of the x-axis (+). Specifically, a base table 28 is provided at a position spaced from the base 12 in the direction of the x-axis (+), and the clamping mechanism (30, 32) is provided on the base table 28. The clamping mechanism (30, 32) can be switched by a not-shown driving device between a state of clamping the wire S (a state in which the clamps 30 and 32 make contact with each other) and a state of not clamping the wire S (a state in which the clamps 30 and 32 are separated from each other). Since the position of the base table 28 does not change relative to the base 12, the position of the clamping mechanism (30, 32) also does not change relative to the base 12.

In addition, the forming device 10 comprises a controller 34 configured to control respective parts of the forming device 10. The controller 34 is constituted by a computer comprising a CPU, ROM, and/or RAM. CAD data defining the design shape of the coil spring S (including the shape of the pigtail $S_2$) is inputted into the controller 34. The controller 34 controls each of the driving devices based on the inputted CAD data. Due to this, when the pigtail $S_2$ is formed, the moving table 16 moves in the z-axis direction, the slider 18 moves in the x-axis direction and in the y-axis direction, the slider 18 rocks about the z-axis, and the rotating shaft 20 rotates about its axis and rocks about the y-axis. Furthermore, the controller 34 controls the clamp 24 and the clamping mechanism (30, 32) so as to switch between the states of clamping and not clamping the wire S. By the controller 34 controlling each part of the forming device 10, the pigtail $S_2$ is formed at the end of the wire material having the semi-finished product shape S.

Operation of the forming device 10, when forming the pigtail $S_2$ at the end of the wire material having the semi-finished product shape S using the forming device 10 described above, will be described. First, the wire material having the semi-finished product shape S is set on the forming device 10. Specifically, the controller 34 activates each of the driving devices so as to make the moving table 16, the slider 18, and the rotating shaft 20 move to respective initial positions. Next, the wire material having the semi-finished product shape S is transported into the forming device 10 by a not-shown robot or the like. When the wire material having the semi-finished product shape S has been transported, the controller 34 activates the clamping mechanism (30, 32) to clamp a particular position of the wire S, and activates the clamp 24 to clamp an end (an end on the side where the pigtail $S_2$ is not formed) of the wire S on the coiling mandrel 26.

Next, in a state where the particular position and the end of the wire rod S are clamped, the controller 34 controls each of the driving devices configured to drive the moving table 16, the slider 18, and the rotating shaft 20, in accordance with the CAD data defining the final product shape of the coil spring S. Due to this, the moving table 16 is moved in the z-axis direction, and/or the slider 18 is moved in the x-axis direction, and/or the slider 18 is moved in the y-axis direction, and/or the slider 18 is rockingly rotated about the z-axis, and/or the rotating shaft 20 is rotated about its axis, and/or the rotating shaft 20 is rockingly rotated about the y-axis. As a result, the pigtail $S_2$ is formed at the end of the wire material having the semi-finished product shape S.

Here, during the forming of the pigtail $S_2$, when the rotating shaft 20 is rotated about its axis, the wire S is wound on the outer circumferential surface 26*a* of the coiling mandrel 26. Since the pigtail $S_2$ is formed by winding the wire S on the outer circumferential surface 26*a* of the coiling mandrel 26, the pigtail $S_2$ can be formed with fine accuracy. In addition, by moving the moving table 16 and the slider 18 and rockingly rotating the slider 18 and the rotating shaft 20 during the forming of the pigtail $S_2$, the axial line and the pitch of the pigtail $S_2$ can be controlled freely. As a result, the pigtail $S_2$ is formed so as to have the final product shape defined in the CAD data.

When the pigtail $S_2$ has been formed, the clamp 24 is driven to release the end of the wire S, and the clamping mechanism (30, 32) is driven to release the particular position of the wire S. Next, the coil spring S in the final product shape is transported by a not-shown robot or the like out of the forming device 10. Due to this, the pigtail $S_2$ is formed on the wire material having the semi-finished product shape S.

As is apparent from the description above, in the coil spring forming method of the present embodiment, the pitch of the pigtail $S_2$ to be formed can be controlled to be any arbitrary pitch, by moving the slider 18 (the rotating shaft 20 and the coiling mandrel 26) in the x-axis direction when forming the pigtail $S_2$ at the end of the wire material having the semi-finished product shape S. In addition, the pigtail $S_2$ can be formed into a desired shape by appropriately moving the table 16, and the slider 18 and the rotating shaft 20 when forming the pigtail $S_2$. In particular, since the controller 34 drives the table 16, the slider 18, and the rotating shaft 20 based on the CAD data, the coil spring S having the shape (design shape) defined in the CAD data can be formed.

Specific examples of the present invention have been described in detail; however, these are merely exemplifications and thus do not limit the scope of the claims. The techniques described in the claims include modifications and variations of the specific examples presented above.

For example, in the embodiment described above, although the rotating shaft 20 (the coiling mandrel 26) has been described as being movable in the x-axis direction, the y-axis direction, and the z-axis direction, and as being rockingly rotatable about the y-axis and the z-axis, the present invention is not limited to this configuration. For example, a configuration may be implemented in which the rotating shaft 20 (the coiling mandrel 26) is movable only in the x-axis direction, the y-axis direction, and the z-axis direction, or a configuration may be implemented in which the rotating shaft 20 (the coiling mandrel 26) is movable in the x-axis direction and rockable about the y-axis and the z-axis, or a configuration obtained by suitably selecting from some of these movement modes may be implemented. Even with such configurations, the pitch of a pigtail can be adjusted. Furthermore, in the embodiment described above, although the rotating shaft 20 is constituted as a single component, the rotating shaft may be constituted by two components, i.e., a proximal end part and a distal end part. In such a case, the distal end part may be configured to be rockingly rotatable relative to the proximal end portion about the y-axis (an axis extending in the horizontal direction orthogonal to an axial line of the proximal end portion), and/or rockingly rotatable about the z-axis (an axis extending in the vertical direction orthogonal to the y-axis). Thus, various configurations can be implemented for a moving mechanism configured to adjust the position of the clamp 24. Furthermore, the coiling mandrel 26 is not necessarily required, and the pigtail may be formed without using the coiling mandrel 26.

Technical features described in the description and the drawings may technically be useful alone or in various combinations, and are not limited to the combinations as originally claimed. Further, the techniques described in the description and the drawings may concurrently achieve a plurality of aims, and technical significance thereof resides in achieving any one of such aims.

The invention claimed is:

1. A method for forming a wire into a coil spring having a desired shape, the method comprising:

forming the wire into the coil spring having a cylindrical shape by winding the wire on a first coiling mandrel, and further processing one end of the wire of the coil spring that has been formed into the cylindrical shape by:

clamping the coil spring at a particular position other than the one end of the wire of the coil spring that has been formed into the cylindrical shape, clamping the one end of the wire of the coil spring that has been formed into the cylindrical shape, and moving the clamped one end of the wire relative to the clamped particular position at least in an axis direction of the coil spring that has been formed into the cylindrical shape, wherein the further processing is performed while the one end of the wire of the coil spring is clamped in a clamp provided on a rotating shaft having a longitudinal axis, and the moving step further includes rotationally moving the clamped one end of the wire of the coil spring relative to the clamped particular position about an x-axis and a y-axis or about the x-axis and a z-axis, or about the x-axis and the y-axis and the z-axis, the x-axis being the longitudinal axis of the rotating shaft, the y-axis being orthogonal to the x-axis, and the z-axis being orthogonal to the x-axis and to the y-axis.

2. The method according to claim 1, wherein the moving step further includes moving the clamped one end of the wire of the coil spring relative to the clamped particular position in an x-axis direction, and/or in a y-axis direction, and/or in a z-axis direction.

3. The method according to claim 2, wherein a second coiling mandrel is further provided on the rotating shaft, and in the moving step, the wire of the coil spring is wound on the second coiling mandrel while moving the clamped one end of the wire of the coil spring relative to the clamped particular position.

4. The method according to claim 3, wherein in the moving step, the second coiling mandrel moves integrally with the clamped one end of the wire in the x-axis direction, and/or in the y-axis direction, and/or in the z-axis direction.

5. The method according to claim 4, wherein the further processing is performed while the coil spring is at a temperature of 300° C. or higher.

6. The method according to claim 1, wherein a second coiling mandrel is further provided on the rotating shaft, and in the moving step, the wire of the coil spring is wound on the second coiling mandrel by moving the clamped one end of the wire of the coil spring relative to the clamped particular position.

7. The method according to claim 6, wherein in the moving step, the second coiling mandrel moves integrally with the clamped one end of the wire in the x-axis direction, and/or in the y-axis direction, and/or in the z-axis direction.

8. The method according to claim 1, wherein the further processing is performed while the coil spring is at a temperature of 300° C. or higher.

9. The method according to claim 1, wherein the moving step is performed such that a first portion of the coil spring between the clamped one end of the wire and the clamped particular position has a different pitch than a second portion of the coil spring between the clamped particular position and an opposite end of the wire.

10. The method according to claim 1, wherein the moving step is performed such that a first portion of the coil spring between the clamped one end of the wire and the clamped particular position has a smaller diameter than a second portion of the coil spring between the clamped particular position and an opposite end of the wire.

11. A coil spring forming device comprising:

a first clamp configured to clamp one end of a wire of a coil spring that has been formed into a cylindrical shape, a second clamp configured to clamp a particular position of the coil spring other than the one end of the wire of the coil spring that has been formed into the cylindrical shape, a moving mechanism configured to move the first clamp relative to the second clamp at least in an axis direction of the coil spring that has been formed into the cylindrical shape, and a controller configured to drive the moving mechanism while the wire of the coil spring is clamped by the first clamp and the second clamp, and to move the first clamp relative to the second clamp at least in the axis direction of the coil spring, wherein the first clamp is provided on a rotating shaft having a longitudinal axis, wherein the moving mechanism is configured to rotationally move the first clamp relative to the second clamp about an x-axis and a y-axis, or about the x-axis and a z-axis, or about the x-axis and the y-axis and the z-axis, the x-axis being the longitudinal axis of the rotating shaft, the y-axis being orthogonal to the x-axis, and the z-axis being orthogonal to the x-axis and to the y-axis, and wherein the controller is configured to drive the moving mechanism while the wire of the coil spring is clamped by the first clamp and the second clamp, and to rotationally move the first clamp relative to the second clamp about the x-axis and the y-axis, or about the x-axis and the z-axis, or about the x-axis and the y-axis and the z-axis.

12. A coil spring forming device comprising:

a first clamp configured to clamp one end of a wire of a coil spring that has been formed into a cylindrical shape, a second clamp configured to clamp a particular position of the coil spring other than the one end of the wire of the coil spring that has been formed into the cylindrical shape, a moving mechanism configured to move the first clamp relative to the second clamp at least in an axis direction of the coil spring that has been formed into the cylindrical shape, and a controller configured to drive the moving mechanism while the wire of the coil spring is clamped by the first clamp and the second clamp, and to move the first clamp relative to the second clamp at least in the axis direction of the coil spring, wherein the moving mechanism comprises:

a table movable in a z-direction;

a slider mounted on the table so as to be movable relative to the table in a x-direction and in a y-direction, which are orthogonal to each other and to the z-direction;

a rotating shaft rotatably mounted on the slider; and a coiling mandrel provided on or near a free end of the rotating shaft, wherein the first clamp is also provided on or near the free end of the rotating shaft.

13. The coil spring forming device according to claim 12, wherein the coiling mandrel and the first clamp are configured to clamp the one end of the coil spring on or near the free end of the rotating shaft.

14. The coil spring forming device according to claim 13, wherein:

the second clamp is provided on a base table that is spaced from the moving mechanism, and the rotating shaft is movable relative to the base table in the x-direction, in the y-direction and in the z-direction.

15. The coil spring forming device according to claim 14, wherein the rotating shaft is configured to rotate about its rotational axis while rocking about the y-direction.

16. The coil spring forming device according to claim 15, wherein the controller comprises a memory storing CAD data that, when executed by a processor, cause the processor to drive the table and/or the slider such that the rotating shaft moves in the x-direction, the y-direction and the z-direction.

17. The coil spring forming device according to claim 12, including a lift configured to lift the table in the z-direction.

18. The coil spring forming device according to claim 12, wherein the second clamp is provided on a base table that is spaced from the moving mechanism.

19. A method for forming a wire into a coil spring, comprising:

winding the wire around a coiling mandrel to form the wire into a cylindrical coil shape having a first pitch, clamping one end of the wire formed into the cylindrical coil shape, clamping an intermediate portion of the wire having the cylindrical coil shape at a location spaced from the clamped one end of the wire; and moving the clamped one end of the wire relative to the clamped intermediate position at least in an axis direction of the cylindrical coil shape, wherein a pigtail having a second pitch is formed between the clamped intermediate position and the clamped one end of the wire, the second pitch being different than the first pitch, wherein the moving step is performed while the one end of the wire of the coil spring is clamped in a clamp provided on a rotating shaft having a longitudinal axis, and wherein the moving step further includes rotationally moving the clamped one end of the wire of the coil spring relative to the clamped intermediate position about an x-axis and a y-axis, or about the x-axis and a z-axis, or about the x-axis and the y-axis and the z-axis, the x-axis being the longitudinal axis of the rotating shaft, the y-axis being orthogonal to the x-axis, and the z-axis being orthogonal to the x-axis and the y-axis.

20. The method according to claim 19, wherein, during the moving step, the clamped one end of the wire is moved relative to the clamped intermediate position so as to decrease the diameter of a portion of the cylindrical coil shape between the clamped one end and the clamped intermediate position.

* * * * *